US012498192B2

(12) United States Patent
Fischer et al.

(10) Patent No.: US 12,498,192 B2
(45) Date of Patent: Dec. 16, 2025

(54) SILENCER FOR A HANDGUN, WITH A DISPLACEABLE ATTACHING RAIL

(71) Applicants: Oliver Fischer, Lochau (AT); Karl-Heinz Plankel, Dornbirn (AT)

(72) Inventors: Oliver Fischer, Lochau (AT); Karl-Heinz Plankel, Dornbirn (AT)

( * ) Notice: Subject to any disclaimer, the term of this patent is extended or adjusted under 35 U.S.C. 154(b) by 0 days.

(21) Appl. No.: 18/420,574

(22) Filed: Jan. 23, 2024

(65) Prior Publication Data

US 2025/0237456 A1 Jul. 24, 2025

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 89/14.4
See application file for complete search history.

(56) References Cited

U.S. PATENT DOCUMENTS 7,194,836 B1 * 3/2007 Urban ..... F41C 27/22 89/14.05
10,890,400 B2 1/2021 Christandl
2019/0086173 A1 * 3/2019 Lee ..... F41A 21/325

FOREIGN PATENT DOCUMENTS

DE 102015017246 B3 * 12/2022 ..... F41A 21/30
EP 3 390 953 A1 12/2019

* cited by examiner

*Primary Examiner* — Samir Abdosh
(74) *Attorney, Agent, or Firm* — Ruggiero McAllister & McMahon LLC

(57) ABSTRACT

The present invention relates to a silencer for mounting on a handgun having a barrel with a barrel extension and a frame with a mounting rail and a trigger guard, including a mounting portion provided and adapted to fixedly receive at least a part of the barrel of the handgun; and an attaching rail provided and adapted to support the silencer on the trigger guard of the handgun; the attaching rail is slidable relative to the mounting portion along a longitudinal direction of the silencer to adjust the silencer to a varying distance between the barrel extension and the trigger guard. The invention further relates to a method for adjusting a silencer on a handgun.

22 Claims, 5 Drawing Sheets

SILENCER FOR A HANDGUN, WITH A DISPLACEABLE ATTACHING RAIL

BACKGROUND

1. Field of the Disclosure

The present invention relates to a silencer for mounting on a handgun, a system comprising a handgun and a silencer, and a method for adjusting a silencer on a handgun.

2. Description of the Related Art

Silencers are used as accessories for handguns, for example to reduce the sound emissions when a shot is fired. After a shot has been fired, the natural vibration of the handgun may differ from that of the silencer. In order to minimize the resulting vibration difference between the handgun and the silencer, it is desirable to mount the silencer robustly on the handgun.

The European patent application EP 3 390 953 A1 discloses a solution that minimizes horizontal and vertical vibration of the handgun relative to the silencer. For this purpose, it provides a mounting device separate from the silencer, the convex support surface of which ensures reliable support on a trigger guard of the handgun.

The selection of handguns is large. The Glock company, for example, sells models such as ® Glock19 in generations 3, 4, 5, ® Glock17 in generations 3, 4, 5, ® Glock22 in generations 3, 4, 5, ® Glock23 in generations 3, 4, 5, ® Glock31 in generations 3, 4, 5, ® Glock19x, ® Glock44, ® Glock45. These models differ in their dimensions and measurements. The situation is similar, for example, with Smith & Wesson models.

The growing number of handgun models is accompanied by a growing number of silencers. This is because in order to enable a robust, low-vibration coupling between the handgun and the silencer, the silencer must be fitted precisely to the respective handgun model.

SUMMARY

It is the object of the present invention to provide an improved silencer for mounting on a handgun, an improved system comprising a handgun and a silencer, and an improved method for adjusting a silencer on a handgun. In particular, the invention is directed to a silencer that is adjustable so as to be mountable on various models of handguns without compromising the robust and low-vibration coupling between the handgun and the silencer. The invention may further be based on the fact that the silencer and the method of adjustment are easy to operate, stable and robust.

The problem is solved by a device and a method with the features of the independent claims. Advantageous further embodiments result from the subclaims, the description and the figures.

Accordingly, a silencer for mounting on a weapon, in particular a handgun, is proposed. The handgun has a barrel with a barrel extension and a frame with a mounting rail and a trigger guard. The handgun may have a breechblock in addition to the frame. The breech can include a movable slide and the fixed barrel, which serves to accelerate and guide the projectile and to hold the propellant charge or cartridge. The front part of the barrel may be referred to as the muzzle. The barrel extension can be the part of the barrel that protrudes from the slide in a rest position. The attachment of the silencer to the handgun refers to the reversible, functional coupling between the silencer and the handgun. As soon as the silencer is attached to the handgun, the desired reduction in sound emission is made possible by the silencer.

The silencer has a receiving portion which is configured and adapted to receive at least a part of the barrel of the weapon, for example the muzzle of the handgun, in a fixing manner, for example to accommodate it in a defined position. The receiving portion can be part of a hollow body unit of the silencer, which has damping fins or damping plates in order to reduce the sound emission. The damping fins can be arranged on a side of the receiving portion facing away from the handgun. The receiving portion can be designed in such a way that the handgun can be inserted into it in a defined position. Fixing manner can be understood to mean that a relative movement between the silencer and the handgun is prevented after the insertion of the at least one part of the barrel of the handgun into the receiving portion, so that a difference in vibration between the silencer and the handgun is minimized. The receiving portion can have a hollow volume which is at least in sections complementary to a geometry of the muzzle of the handgun.

The silencer also has an attaching rail which is configured and adapted to support the silencer on the trigger guard of the handgun. In addition to the support function, the attaching rail can also be used to attach accessories such as tactical lights or handles. For this purpose, it can form a mounting profile in accordance with STANAG standardization. The attaching rail can be in contact with the trigger guard in a supporting manner in order to promote the robust, low-vibration coupling between the handgun and the silencer. In particular, the attaching rail can prevent the silencer from vibrating vertically relative to the handgun. The attaching rail can be slightly inclined in relation to the mounting rail, for example by 1° or 2°, in particular 1.5°. This is because the mounting rail of the handgun can be inclined relative to the barrel, for example because the mounting rail is manufactured using an injection molding process, so that when the mounting rail cools down, a distortion of, for example, 1.5° relative to the barrel occurs. This distortion of the mounting rail can be compensated for by an opposite alignment of the attaching rail.

The attaching rail can be displaced relative to the receiving portion along a longitudinal direction of the silencer in order to adjust the silencer to a varying distance between the barrel extension and the trigger guard. The longitudinal direction corresponds to the axis along which a projectile passes through the handgun and the silencer. The attaching rail can assume a first setting in which there is a first distance between the end of the attaching rail facing the trigger guard and the receiving portion and a second setting in which there is a second distance between the end of the attaching rail facing the trigger guard and the receiving portion. The first distance can be greater than the second distance. The first distance can fit a first model of a handgun, so that the attaching rail assumes a position such that it reliably supports the silencer on the trigger guard of the handgun of the first model. The second distance can fit a second model of handgun so that the attaching rail assumes such a position that it reliably supports the silencer on the trigger guard of the handgun of the second model. By means of the displacement along the longitudinal direction, which in one embodiment can be superimposed by a displacement along a vertical direction orthogonal to the longitudinal direction and in another embodiment can be a pure longitudinal displacement, it can be achieved that the attaching rail and thus the silencer fits precisely on the handgun. It is conceivable to provide different attaching rails for a silencer, which differ in length, in order to adapt the silencer to different distances between the barrel extension and the trigger guard.

This makes it possible to adapt the silencer to the handgun. Instead of requiring a separate, precisely matched silencer for each model of handgun, a silencer can apparently be used universally for different models of handguns without impairing the robust and low-vibration coupling between the handgun and the silencer. The silencer can compensate for different dimensions and geometries of handguns, in particular different breech lengths and muzzles, thanks to the movable and thus adjustable attaching rail. The silencer according to the disclosure is easy to operate, stable and robust.

In one embodiment, the attaching rail has a first locking opening and a second locking opening, wherein a locking pin mounted in the receiving portion is seated in the first locking opening for a first setting and is seated in the second locking opening for a second setting. The locking mechanism for adjusting the displacement between the attaching rail and the receiving portion can be a manually operable mechanism from the selection of plug-in mechanism, tilting mechanism and sliding mechanism.

In one embodiment, the locking pin is preloaded towards the attaching rail in a locking direction that is orthogonal to the longitudinal direction of the silencer. To adjust the attaching rail relative to the receiving portion, the locking pin can be moved against the preload to prevent it from engaging in the respective locking opening, so that the attaching rail can be moved longitudinally.

In an alternative embodiment to the locking pin, the attaching rail has an opening, in particular a thread, into which a locking means, in particular a worm screw or trapezoidal screw, can be inserted, i.e. is insertable, so that the position of the attaching rail can be continuously adjusted in relation to the receiving portion. This means that the attaching rail is not dependent on fixed locking openings for its adjustment, but can be infinitely adjusted in its position relative to the receiving portion. The locking means can be tightened and loosened using a tool, in particular a screwdriver.

In one embodiment, a guiding rail for guiding at least part of the barrel is arranged in the receiving portion, the guiding rail being a separate component, in particular made of a polymer material, in order to promote thermal separation between the silencer and the handgun. The receiving portion can be part of a hollow body unit, which is formed from two shells, in particular aluminum shells, screwed together. The guiding rail is formed separately from this. It can be screwed to the receiving portion. In particular, if the handgun is used in rapid-fire mode, this can lead to the receiving portion heating up considerably, especially if it is made of a metal such as aluminum. To ensure that the receiving portion exerts no or only a low heat input on the handgun, the receiver rail is designed as a separate component in order to achieve thermal separation. In particular, the receiver rail can be manufactured from a polymer material using an injection molding process in order to promote the effectiveness of the thermal separation.

In one embodiment, the attaching rail forms, on a side facing the trigger guard, a support surface which is perpendicular and flat to the longitudinal direction of the silencer and which is configured and adapted to be in line contact with a section of the trigger guard for supporting the silencer on the trigger guard. The line contact prevents a vertical relative vibration between the silencer and the handgun. The line contact can be designed to enable force transmission exclusively along the longitudinal direction. The attaching rail can have a stabilizer in the area of the flat support surface, which protrudes from the attaching rail in the direction of the mounting rail in order to further protect the silencer from tilting relative to the handgun. The attaching rail can also form a stabilizing extension that adjoins the support surface in the longitudinal direction to form a shoulder. The stabilizer and/or the stabilizing extension helps to prevent the silencer from swinging vertically relative to the handgun.

In one embodiment, the attaching rail is pushed onto a link section of the receiving portion in a form-fit manner, i.e., with a positive fit. The link section can form an undercut that engages in an upper part of the attaching rail, which can have a T-profile in cross-section, in order to displaceably support the attaching rail.

In one embodiment, a first engagement bolt and a second engagement bolt offset from the first engagement bolt along the longitudinal direction of the silencer are arranged in the receiving portion in order to engage in a transverse slot in the mounting rail of the handgun, wherein, depending on a position of the transverse slot, either the first engagement bolt or the second engagement bolt is configured and adapted to engage in the transverse slot, wherein, in particular, the first engagement bolt is offset from the second engagement bolt by 12 mm. The first engagement bolt and the second engagement bolt can be identical in design. They can be adapted to the respective dimension and size of the transverse slot in the mounting rail of the handgun. The respective engaged latch can create a positive fit between the silencer and the handgun in the longitudinal direction, which further contributes to the robust connection. The engagement mechanism between the receiving portion and the handgun can be a manually operated mechanism from the selection of plug-in mechanism, tilting mechanism and sliding mechanism.

In one embodiment, the first engagement bolt and the second engagement bolt are pretensioned in an engagement direction that is orthogonal to the longitudinal direction, facing away from the attaching rail. The engagement direction can be opposite to the locking direction. For example, the locking pin can be pretensioned downwards and the respective engagement bolt upwards. In an operating state, the first and second engagement bolts engage in a mounting rail of the handgun.

In one embodiment, an adapter plate is received in the receiving portion, in particular in a recess, which adapter plate has a fixing opening which is configured and adapted to receive the barrel extension in a fixing manner. The adapter plate can serve as a stop for the handgun in the longitudinal direction. With its fixing opening, it can also fix the handgun in the plane orthogonal to the longitudinal direction. The adapter plate, in conjunction with the first and second locking latch and the attaching rail, can help to enable robust, low-vibration coupling between the handgun and the silencer. The inlet can be connected to a receiving contour that is configured and adapted to accommodate the muzzle of the handgun. Adapter plates can be arranged at different longitudinal positions in order to compensate for a varying length of the mounting rail. In such an embodiment, it is possible to use only one engagement bolt. In this way, the engagement bolt can engage in the transverse slot in the mounting rail and the corresponding longitudinal offset can be compensated for by the varying position of the adapter plate. The adapter plate, the at least one engagement bolt and the attaching rail can each separately realize a single aspect of the support of the silencer on the handgun.

In one embodiment, the adapter plate is formed separately from the receiving portion and is positively engaged in the receiving portion, with the adapter plate in particular being made of aluminum. This makes it possible to efficiently adapt the silencer to different models of handguns, for example by only having to replace the adapter plates. A single adapter plate can be replaced with little maintenance. It can be inserted into a recess in the receiving portion that is adapted to the outer dimensions of the adapter plate. Different adapter plates are similar in their outer dimensions, but differ in the dimensions of their fixing opening in order to efficiently and reliably accommodate different models of handguns.

In one embodiment, the silencer has a hollow body unit with damping fins, whereby the hollow body unit forms the receiving portion, wherein in particular the hollow body unit is formed from two shells screwed together, in particular aluminum shells. The silencer can therefore consist of a hollow body unit, the attaching rail, as well as the engagement bolts and the locking pin including pretensioning elements. The total number of components can therefore be very small, which has a favorable effect on robustness. The two shells of the hollow body unit can be essentially identical to each other, which further simplifies their mass production. The shells of the hollow body unit can be reversibly connected to each other by means of a large number of screws, for example 5, 7 or 9 screws. The damping fins can be inclined to the longitudinal axis in order to efficiently absorb the sound emissions.

In one embodiment, the attaching rail is an injection-molded part, in particular a polymer injection-molded part, separate from the receiving portion. The injection-molded part is suitable for forming a mounting profile for holding accessories such as tactical lights or handles. The mounting profile can be designed in accordance with STANAG standardization.

The disclosure further relates to a system comprising a handgun having a barrel with a barrel extension and a frame with a trigger guard, and a silencer. The silencer may have the features of the present disclosure individually or in combination. The silencer has a receiving portion that receives at least a portion of the barrel of the handgun. The receiving portion can be part of a hollow body unit of the silencer, which has damping fins in order to achieve the reduction of the sound emission. The damping fins can be arranged on a side of the receiving portion facing away from the handgun. The receiving portion can be designed in such a way that the handgun can be inserted into it in a defined position. The receiving portion can accommodate a part of the barrel of the handgun, for example the muzzle of the handgun, in a fixed position, for example in a defined position.

The silencer of the system further comprises an attaching rail that is displaceable and/or slidable along a longitudinal direction of the silencer to adjust the silencer to a varying distance between the barrel extension and the trigger guard so that the attaching rail is supported on the trigger guard of the handgun. The attaching rail is in contact with the trigger guard in a supporting manner in order to promote the robust, low-vibration coupling between the handgun and the silencer. In particular, the attaching rail can prevent the silencer from vibrating vertically relative to the handgun. The attaching rail can be slightly inclined relative to the mounting rail, for example by 1° or 2°, in particular 1.5°. The attaching rail can assume a first setting in which there is a first distance between the end of the attaching rail facing the trigger guard and the receiving portion and a second setting in which there is a second distance between the end of the attaching rail facing the trigger guard and the receiving portion. The first distance can be greater than the second distance. The first distance can fit a first model of a handgun, so that the attaching rail assumes a position such that it reliably supports the silencer on the trigger guard of the handgun of the first model. The second distance can fit a second model of handgun so that the attaching rail assumes such a position that it reliably supports the silencer on the trigger guard of the handgun of the second model. By means of the displacement along the longitudinal direction, which in one embodiment can be superimposed by a displacement along a vertical direction orthogonal to the longitudinal direction and in another embodiment can be a pure longitudinal displacement, it can be achieved that the attaching rail and thus the silencer fits precisely on the handgun.

This makes it possible to adapt the silencer to the handgun. Instead of requiring a separate, precisely matched silencer for each model of handgun, a silencer can apparently be used universally for different models of handguns without impairing the robust and low-vibration coupling between the handgun and the silencer. The silencer can compensate for different dimensions and geometries of handguns, in particular different breech lengths and muzzles, thanks to the movable and thus adjustable attaching rail. The system according to the disclosure is easy to operate, stable and robust.

In one embodiment, a gap is formed between the attaching rail and the mounting rail so that the attaching rail does not receive any load input directly from the mounting rail. The gap reduces the mass of the system, which is an ergonomic advantage. Furthermore, the gap prevents the load from being applied directly from the mounting rail to the attaching rail, which is beneficial for separating the function of the individual attachment points between the silencer and the handgun.

In one embodiment, on a side facing the trigger guard, the attaching rail forms a flat support surface at right angles to the longitudinal direction of the silencer, which is in line contact with a section of the trigger guard for supporting the silencer on the trigger guard. The line contact prevents a vertical relative vibration between the silencer and the handgun. The line contact can be designed to enable power transmission exclusively along the longitudinal direction.

In one embodiment, a first engagement bolt and a second engagement bolt offset from the first engagement bolt along the longitudinal direction of the silencer are arranged in a receiving portion of the silencer in order to engage in a transverse slot in the mounting rail of the handgun, wherein in a first setting the first engagement bolt engages in the transverse slot and the second engagement bolt does not assume an engagement function. The first latching bar and the second latching bar can be identical to each other. They can be adapted to the respective dimension and size of the transverse slot in the mounting rail of the handgun. The respective engaged latch can create a positive fit between the silencer and the handgun in the longitudinal direction, which further contributes to robust binding.

In one embodiment, an adapter plate is accommodated in the receiving portion of the silencer, which has a fixing opening that is adapted to the handgun in terms of its size in order to accommodate the barrel extension in a fixing manner. The adapter plate can serve as a stop for the handgun in the longitudinal direction. With its fixing opening, it can also fix the handgun in the plane orthogonal to the longitudinal direction. The adapter plate, in conjunction with the first and second locking latch and the attaching rail, can help to enable robust, low-vibration coupling between the handgun and the silencer. The adapter plate, the first and second engagement bolt and the attaching rail can separately realize a single aspect of supporting the silencer on the handgun. The adapter plate can efficiently adapt a single silencer to different models of handguns, for example by only having to replace the adapter plates. A single adapter plate can be replaced with little maintenance. It can be inserted into a recess in the receiving portion that is adapted to the outer dimensions of the adapter plate. Different adapter plates are similar in their outer dimensions, but differ in the dimensions of their fixing opening in order to accommodate different models of handguns efficiently and reliably.

The disclosure further relates to a method for adjusting a silencer on a handgun. The silencer and the handgun can be designed in accordance with the preceding and following disclosure. By means of adjusting the silencer to the handgun, it can be achieved that the silencer is adjustable to a varying distance between the barrel extension and the trigger guard of the handgun, in particular in order to use a silencer for a plurality of models of handguns.

The method comprises the step of attaching the silencer to the handgun, in that at least a part of a barrel of the handgun is fixedly received by a receiving portion of the silencer. The attachment of the silencer to the handgun is understood to mean the reversible, functional coupling between the silencer and the handgun. As soon as the silencer is attached to the handgun, the desired reduction in sound emission is made possible by the silencer. The receiving portion can be designed in such a way that the handgun can be inserted into it in a defined position. Fixed mounting can be understood to mean that a relative movement between the silencer and the handgun is prevented after the at least one part of the barrel of the handgun has been mounted in the receiving portion, so that a difference in vibration between the silencer and the handgun is minimized. The attachment can be done manually, for example a user has the silencer in one hand and attaches it to the handgun he has in the other hand.

The method further comprises the step of moving an attaching rail of the silencer so that the attaching rail is in contact with a trigger guard of the handgun to support the silencer on the trigger guard of the handgun. Once it has been moved or displaced accordingly, the attaching rail can be in contact with the trigger guard in a supporting manner in order to promote the robust, low-vibration coupling between the handgun and the silencer. In particular, the attaching rail can thus prevent a vertical relative vibration of the silencer to the handgun. By means of the displacement along the longitudinal direction, which in one embodiment can be superimposed by a displacement along a vertical direction orthogonal to the longitudinal direction, it can be achieved that the attaching rail and thus the silencer fits precisely on the handgun.

This makes it possible to adjust the silencer to the handgun. Instead of requiring a separate, precisely matched silencer for each model of handgun, the adjustment allows a silencer to be used universally for different models of handguns without impairing the robust and low-vibration coupling between the handgun and the silencer. The silencer can compensate for different dimensions and geometries of handguns, in particular different breech lengths and muzzles, thanks to the movable and thus adjustable attaching rail. The method according to the disclosure is easy to operate, stable and error-free.

In one embodiment, displacement is only possible when an attachment means, particularly a locking pin of the silencer, is released, particularly moved against the attaching rail in a locking direction that is orthogonal to the longitudinal direction of the silencer, in particular with the aid of an external tool.

In one embodiment, when the silencer is placed on the handgun, a first engagement bolt, which is offset from a second engagement bolt along the longitudinal direction of the silencer, in particular offset by 12 mm, engages in a transverse slot in a mounting rail of the handgun. The engagement can be manually assisted. The positive fit between the respective engagement bolt and the transverse slot contributes to the robust coupling between the silencer and the handgun.

In one embodiment, when the silencer is mounted on the handgun, an adapter plate with a fixing opening, which is positively received in the receiving portion, fixes a barrel extension of the handgun. The adapter plate can serve as a stop for the handgun in the longitudinal direction. With its fixing opening, it can also fix the handgun in the plane orthogonal to the longitudinal direction. The adapter plate, in conjunction with the first and second locking latch and the attaching rail, can help to enable robust, low-vibration coupling between the handgun and the silencer. The adapter plate, the first and second engagement bolt and the attaching rail can separately realize a single aspect of the support of the silencer on the handgun. The adapter plate can efficiently adapt a single silencer to different models of handguns, for example by only having to replace the adapter plates. A single adapter plate can be replaced with little maintenance. It can be inserted into a recess in the receiving portion that is adapted to the outer dimensions of the adapter plate. Different adapter plates are similar in their outer dimensions, but differ in the dimensions of their fixing opening in order to accommodate different models of handguns efficiently and reliably.

In one embodiment, the method has the following steps before the silencer is mounted on the handgun: opening two housing shells of the silencer, in particular by screwing them on; replacing an adapter plate, the adapter plate having a fixing opening which is configured and adapted to receive a barrel extension of the handgun in a fixing manner; and closing the two housing shells of the silencer, in particular by screwing them on. The two shells can be essentially identical to each other, which further simplifies their mass production. The shells of the hollow body unit can be reversibly connected to each other by means of a large number of screws, for example 5, 7 or 9 screws. The adapter plate can be replaced without tools as soon as the shells are open, because the adapter plate is positively inserted into a corresponding recess in the receiving portion. After screwing it shut, the silencer is ready for use and can achieve the desired reduction in noise emission.

BRIEF DESCRIPTION OF THE DRAWINGS

Embodiments of the disclosure are explained in more detail by the following description of the figures. They show.

DETAILED DESCRIPTION

In the following, examples of embodiments are described with reference to the figures. Here, identical, similar or similarly acting elements in the different figures are provided with identical reference signs, and a repeated description of these elements is partially dispensed with.

Figure 1:
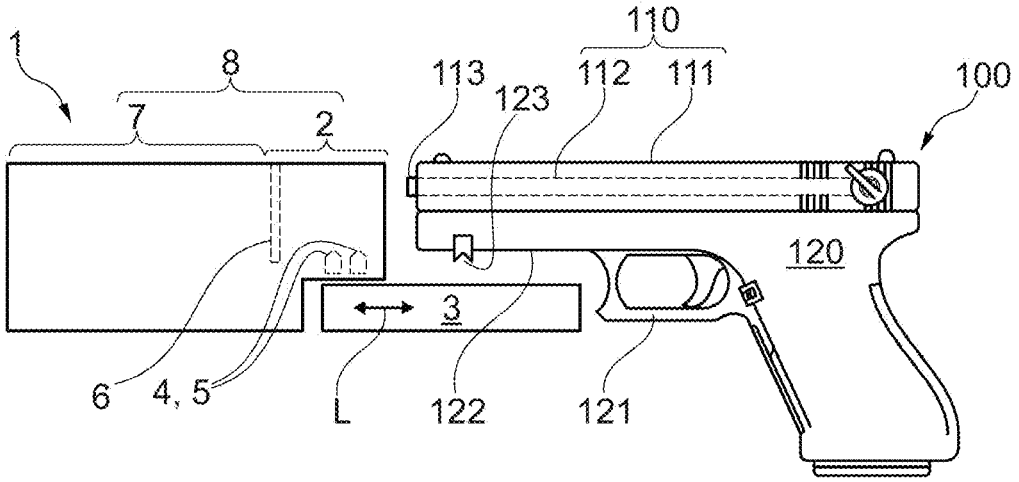
FIG. 1 shows a system comprising a handgun and a silencer.

FIG. 1 schematically shows a system with a silencer 1 and a handgun 100. The handgun 100 has a breech 110 with a movable slide 111 and a fixed barrel 112, which has a barrel extension 113 at the end facing the silencer 1. The barrel extension 113 protrudes from the slide 111 in a rest position. The front part of the barrel 112 can be referred to as the muzzle. The handgun 100 also has a frame 120 with a trigger guard 121 and a mounting rail 122. A transverse slot 123 is provided on the mounting rail, into which the silencer can be engaged (see below).

The silencer 1 can be mounted on the handgun 1 (not shown) in order to reduce the sound emissions. The silencer 1 has a receiving portion 2, which is configured and adapted to receive at least a part of the barrel 112 of the handgun 100 in a fixing manner. The silencer 1 also has an attaching rail 3, which is formed separately from the receiving portion 2 and is configured and adapted to support the silencer 1 on the trigger guard 121. The attaching rail 3 is displaceable along a longitudinal direction L relative to the receiving portion 2 in order to adjust the silencer 1 to a varying distance between the barrel extension 113 and the trigger guard 121. The silencer 1 has a first engagement bolt 4 and a second engagement bolt 5, which are accommodated in the receiving portion 2. Depending on the relative position of the engagement bolts 4, 5 to the transverse slot 123, one of the two engagement bolts 4, 5 engages in the transverse slot 123 of the handgun 100 in order to facilitate the connection of the silencer 1 to the handgun 100. Furthermore, an adapter plate 6 is received in the receiving portion 2, which is configured and adapted to receive the barrel extension 113 in a fixing manner (see below).

The silencer 1 also has a damping portion 7 with damping vanes not shown in FIG. 1. The damping portion 7 adjoins the receiving portion 2. The damping portion 7 and the receiving portion 2 form a hollow body unit 8, which can be made of two shells screwed together, in particular aluminum shells. The shells can be separated from each other along the longitudinal direction L.

Figure 2:
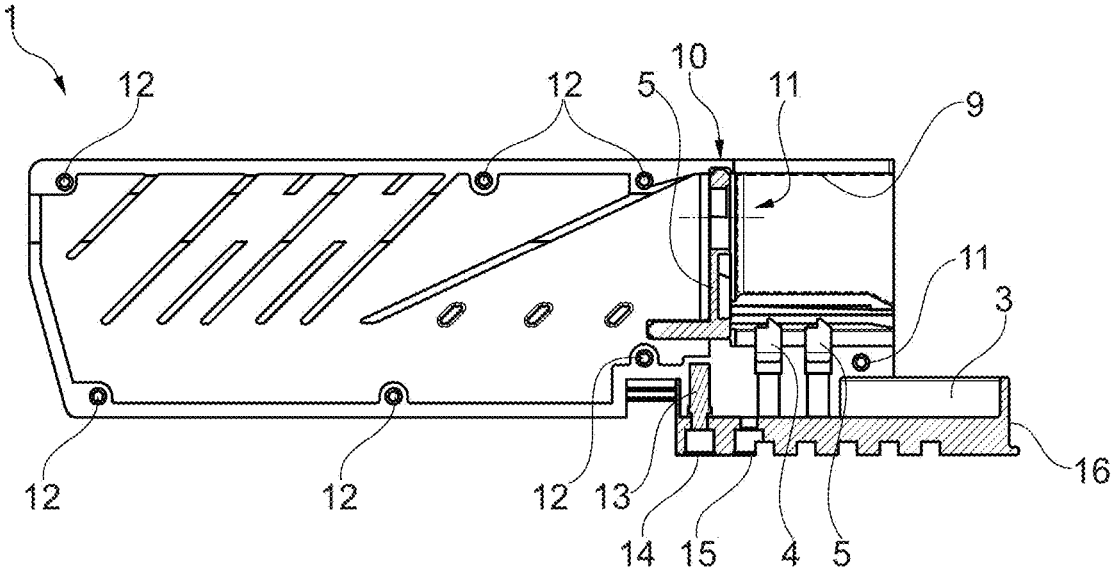
FIG. 2 shows a sectional view of a silencer.

FIG. 2 shows a shell of the silencer 1 in a side view. The receiving portion 2 has a receiving contour 9, which is configured and adapted to receive the muzzle of the handgun 100. The receiving contour 9 accommodates a separate guiding rail 25 for guiding the muzzle of the handgun in order to promote thermal separation between the silencer 1 and the handgun 100 (see FIG. 8). A recess 10, into which the adapter plate 6 is inserted, adjoins the receiving contour 9. The recess 10 and the adapter plate 6 are adapted to each other in the manner of a plug-and-socket principle. The adapter plate 6 can be inserted into the recess 10 with the silencer 1 screwed on. The adapter plate 6 has a fixing opening 11 that is adapted to the dimensions of the handgun 1. For example, a first adapter plate can fit a first model of a handgun. If the silencer 1 is then to be fitted to a second model of handgun, the first adapter plate is removed from the recess 9 in the receiving portion 2 and replaced by a second adapter plate, which also fits positively into the recess 9. The second adapter plate has a fixing opening that differs from the fixing opening of the first adapter plate. The second adapter plate can fit the second model of the handgun accordingly. In the present case, the adapter plate 6 and the corresponding recess 10 are L-shaped. Alternatively, they can also be plate-shaped, i.e., without a profile along the longitudinal direction L. The adapter plate 6 can be made entirely of aluminum. The shell shown can be screwed to a second shell via the holes 12 to form the hollow body unit 8. For example, both shells can be made of a metal, in particular aluminum.

A locking pin 13 is also accommodated in the receiving portion 2. The locking pin 13 is biased towards the attaching rail 3 in a locking direction that is orthogonal to the longitudinal direction L. It can engage either in a first locking opening 14 or in a second locking opening 15. Depending on which locking opening 14, 15 the locking pin 13 engages in, the attaching rail 3 assumes a first setting or a second setting. In the first setting, there is a first distance between the end of the attaching rail 3 facing the trigger guard 121 and the receiving portion 2. In the second setting, there is a second distance between the end of the attaching rail 3 facing the trigger guard 121 and the receiving portion 2. The first distance can be greater than the second distance, so that the silencer in the first setting is adapted to a handgun 1 according to a model which has a greater distance between the trigger guard 121 and the barrel extension 113 than a second model. The silencer 1 can be transferred from the first setting to the second setting by a user using an external tool, for example a screwdriver or a cartridge case, to move the locking pin 13 against the attaching rail 3 along the locking direction, so that a positive fit between the locking pin 13 and the corresponding locking opening 14, 15 is temporarily canceled and the attaching rail 3 can be moved. As soon as the locking pin engages in the corresponding locking opening 14, 15 again after the displacement, the attaching rail is fixed relative to the receiving portion and can therefore reliably assume its support function relative to the trigger guard 121.

A flat support surface 16 at right angles to the longitudinal direction L is formed at the end of the attaching rail 3 facing the trigger guard 121. This is intended to robustly support the attaching rail 3 and thus the silencer 1 relative to the trigger guard 121 and thus the handgun 100. In an operating state of the silencer 1, the support surface 16 is in line contact with a section of the trigger guard 121. The support surface makes it possible to suppress vertical relative vibrations between the silencer 1 and the handgun 100.

Figure 3:
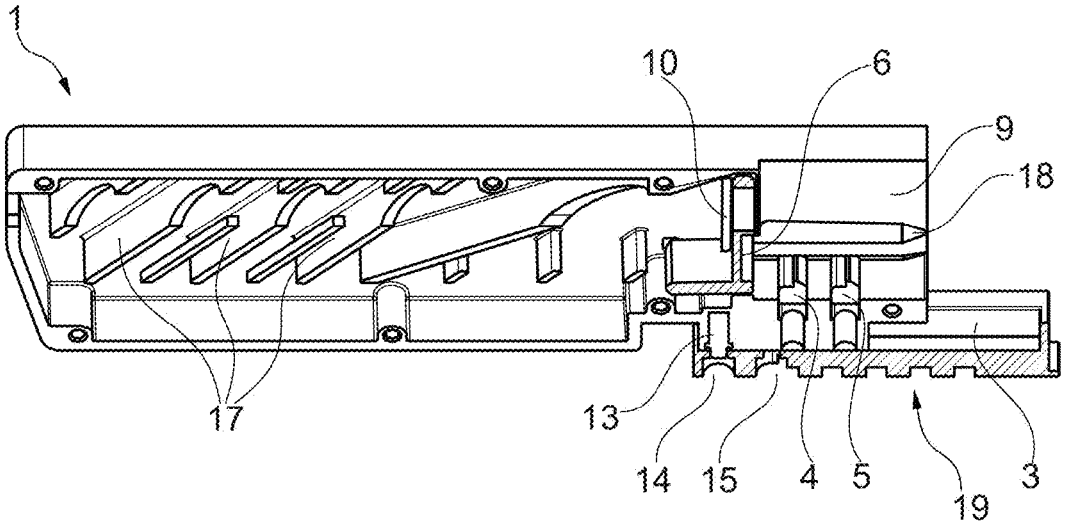
FIG. 3 shows a perspective sectional view of the silencer from FIG. 2.

FIG. 3 shows a perspective view of the shell of the silencer 1 together with the attaching rail 3, locking latch 4, 5, adapter plate 6 and locking pin 13. The hollow body unit 8 has damping fins 17 in the damping portion 7, which reduce the noise emissions during a shot. The adapter plate 6 is held positively in the recess 10. The recess 10 surrounds the adapter plate 6 from both sides. The receiving contour 9 forms an insertion chamfer 18, which makes it easier to attach the silencer 1 to the handgun. The insertion chamfer can be part of the guiding rail 25. The first engagement bolt 4 and the second engagement bolt 5 each have an engagement edge which extends transversely to the longitudinal direction L and which is intended and arranged to engage in the transverse slot 123 of the frame 120 of the handgun 100.

The first and second engagement bolts 4, 5 are each spring-biased in the direction of the transverse slot 123. The locking pin 13 is also preloaded in the direction of the corresponding locking opening 13, 15 of the attaching rail 3. The attaching rail has a fastening profile 19 via which accessories, such as tactical lights or handles, can be attached to the silencer 1.

Figure 4:
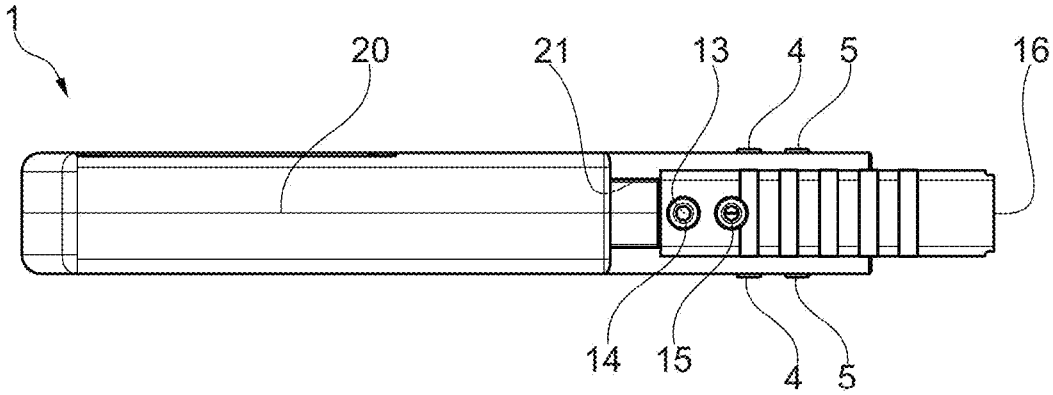
FIG. 4 shows the silencer in a view from below.

FIG. 4 shows the silencer 1 with screwed shells from below. A separating seam 20 between the two shells runs centrally between the two shells. The support surface 16 of the attaching rail 3 protrudes over the receiving portion 2 in order to be able to assume the support function on the trigger guard 121. The mounting profile 19 makes it possible to attach the accessories, which can no longer be attached to the mounting rail 122 of the handgun due to the attached silencer 1, to the silencer 1. The locking pin 13 is located in the first locking opening 14. The second locking opening 15 is correspondingly empty. When the locking pin 13 is actuated manually, the attaching rail 3 can be adjusted in such a way that the locking pin 13 is seated in the second locking opening 15 and the length of the silencer 1 is thus adjusted. The latching latches 4, 5 protrude laterally from the receiving portion 2, i.e., upwards and downwards in FIG. 4, so that they can also be adjusted manually to engage in the transverse slot 123. On the surface facing the attaching rail 3, the receiving portion 2 has a link section 21 which is adapted to allow the attaching rail 3 to be displaced along the longitudinal direction L.

Figure 5:
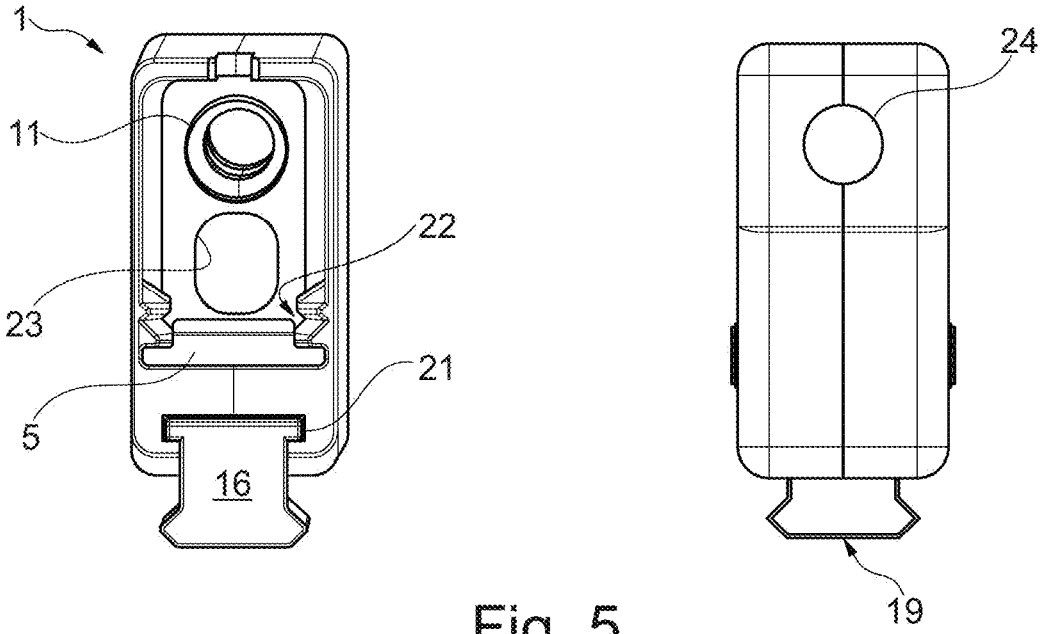
FIG. 5 shows the silencer in a front and rear view.

FIG. 5 shows the silencer 1 from the rear, i.e., the point at which a projectile enters the silencer 1 (left) and from the front, i.e., the point at which a projectile exits the silencer 1 (right). The attaching rail 3 has a watchtower profile. The lower part of the attaching rail 3 forms the mounting profile 19. The upper part of the attaching rail 3 engages positively in the link section 21 of the receiving portion 2. The receiving contour 9 forms a V-gap 22, which facilitates the guidance of the muzzle of the handgun 100 in the receiving portion 2. The engagement edge of the engagement bolts 4, 5 runs perpendicular to the V-gap of the receiving contour 9. In addition to the fixing opening 11, the adapter plate 6 has a fixing recess 23, which further facilitates the fixation of the handgun 100 in the receiving portion 2. The fixing recess 23 is precisely adapted to the respective model of handgun 100. It is designed differently for the various adapter plates 6. The fixing opening 11 is slightly smaller than a silencer opening 24.

Figure 6:
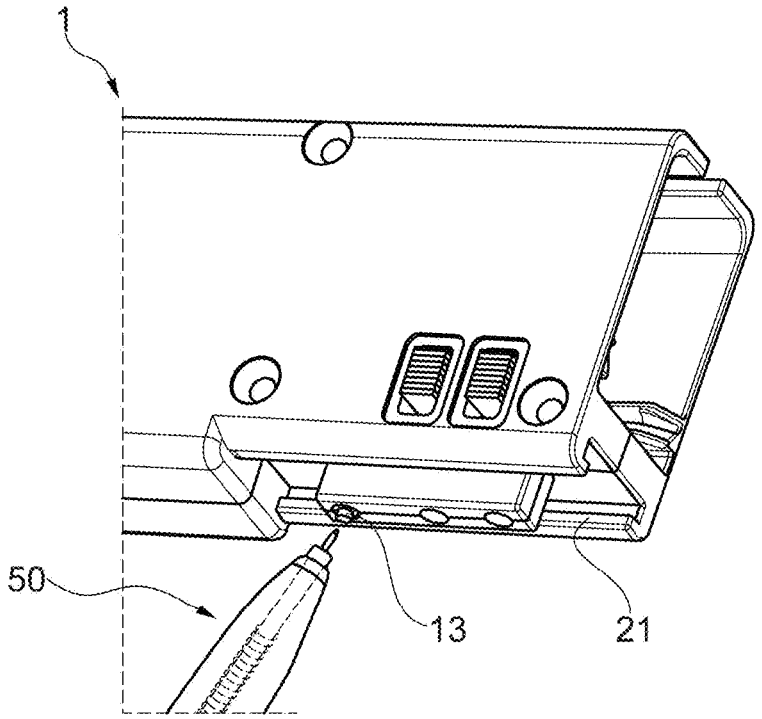
FIG. 6 shows a receiving portion of the silencer, which is adjusted using an external tool.

FIG. 6 shows the receiving portion 2 of the silencer with the attaching rail 3 removed, and an external tool 50 is inserted into the receiving portion 2. The external tool can be a screwdriver, a pin or a projectile sleeve. By means of the external tool 50, the locking pin 13 can be pushed back against its preload so that the locking pin 13 can be transferred from the first locking opening 14 of the (not shown) attaching rail 3 into the second locking opening 15 in order to adjust the silencer 1 to a handgun 1. The link section 21 of the receiving portion 2 forms an undercut into which the attaching rail 3 can positively engage.

Figure 7:
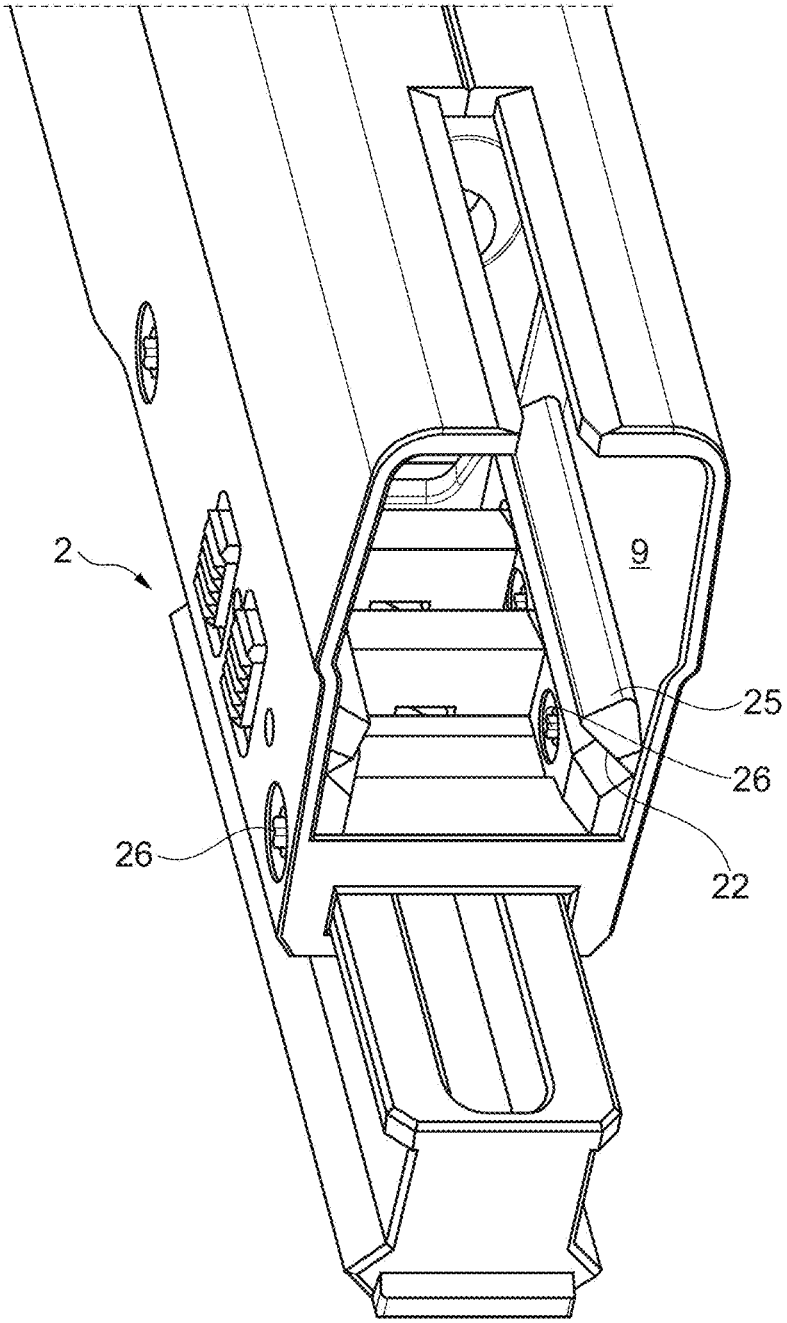
FIG. 7 shows a perspective view of a receiving portion with a guiding rail.

FIG. 7 shows the receiving portion 2 facing the handgun 1. The guiding rail 25 is provided in the receiving contour 9. This is formed as a separate component from the receiving portion 2. In particular, it can be made of a polymer material. The guiding rail 25 forms the V-gap 22, which serves to guide the muzzle of the handgun 1. The guiding rail 25 is fixed in the receiving portion 2 by means of fastening means 26, in particular screws. The receiving portion 2 can be made of a metal, in particular aluminum. The guiding rail 25 thus forms a thermal separation between the silencer 1 and the handgun 100. In particular, if the handgun 100 is used in rapid-fire mode, this can lead to the receiving portion 2 heating up considerably. To ensure that the receiving portion 2 exerts a reduced heat input on the handgun 100, the guiding rail 25 is designed as a separate component to the receiving portion 2 in order to achieve thermal separation.

Figure 8:
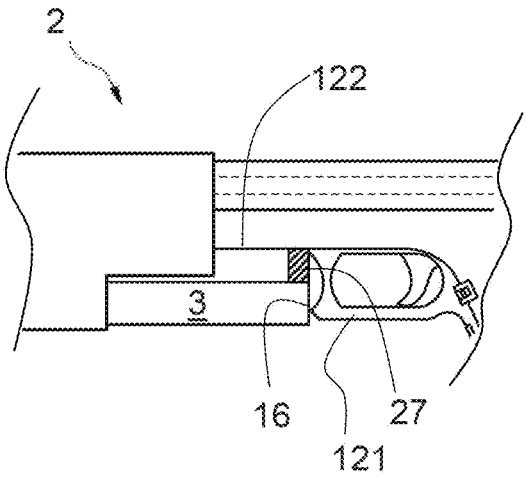
FIG. 8 shows a further embodiment of the attaching rail with a stabiliser.

FIG. 8 shows an embodiment in which the attaching rail 3 has a stabilizer 27. The stabilizer 27 protrudes from the attaching rail 3 in the direction of the mounting rail 122 in order to protect the silencer 1 from tilting relative to the handgun 100 second. The stabilizer 27 can be pretensioned in the direction of the mounting rail 122 or be rigid and unsprung. When the attaching rail 3 is adjusted, the stabilizer 27 is adjusted at the same time. The attaching rail 3 with the stabilizer 27 can be designed in two parts, whereby the materials can differ. The stabilizer 27 helps to prevent the silencer 1 from swinging vertically relative to the handgun 100. The stabilizer 27 can be arranged in a vertical extension to the support surface 16, i.e., at the end of the attaching rail 3 facing the trigger guard 121. Alternatively, there may be an offset between the support surface 16 and the stabilizer 27 in the longitudinal direction L.

Figure 9:
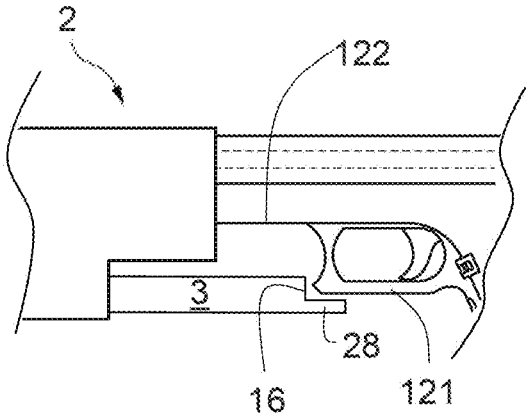
FIG. 9 shows a further embodiment of the attaching rail with a stabilising extension.

FIG. 9 shows an embodiment in which the attaching rail 3 forms a stabilizing extension 28. The stabilizing extension 28 adjoins the support surface 16 in the longitudinal direction and thus forms a shoulder in which the trigger guard engages. In this way, two line contacts can occur between the trigger guard 121 and the attaching rail 3 with the stabilizing extension 28. The support surface 16 of the attaching rail 3 is in line contact with the section of the trigger guard 121 facing the silencer 1 in the longitudinal direction L. In addition, the stabilizing extension 28 is in further line contact with a section of the trigger guard 121 facing away from the frame 120 of the handgun in the vertical direction orthogonal to the longitudinal direction L. The stabilizing extension 28 helps to prevent the silencer 1 from swinging vertically relative to the handgun 100.

As far as applicable, all individual features shown in the embodiment examples can be combined and/or interchanged without leaving the scope of the invention.

LIST OF REFERENCE NUMBERS

1 Silencer
2 Receiving portion
3 Attaching rail
4 First engagement bolt
5 Second engagement bolt
6 Adapter plate
7 Damping portion
8 Hollow body unit
9 Receiving contour
10 Recess
11 Fixing opening
12 Hole
13 Locking pin
14 First locking opening
15 Second locking opening
16 Support surface
17 Damping plates
18 Introduction phase
19 Fastening profile
20 Parting seam
21 Link section
22 V gap
23 Fixing recess
24 Silencer opening
25 Guiding rail

26 Fasteners
27 Stabilizer
28 Stabilizing extension
50 External tool
100 Handgun
110 Breech
111 Sledge
112 Barrel
113 Barrel extension
120 Frame
121 Trigger guard
122 Mounting rail
123 Traverse slot
L Longitudinal direction

What is claimed is:

1. A silencer for mounting on a handgun having a barrel with a barrel extension and a frame with a mounting rail and a trigger guard, the silencer comprising:

a receiving portion configured and adapted to receive at least a part of the barrel of the handgun in a fixing manner; and an attaching rail configured and adapted to support the silencer on the trigger guard of the handgun;

wherein the attaching rail is displaceable relative to the receiving portion along a longitudinal direction of the silencer in order to adjust the silencer to a varying distance between the barrel extension and the trigger guard.

2. The silencer according to claim 1, wherein the attaching rail has a first locking opening and a second locking opening, and a locking pin that is mounted in the receiving portion that is seated in the first locking opening for a first setting and is seated in the second locking opening for a second setting.

3. The silencer according to claim 2, wherein the locking pin is preloaded towards the attaching rail in a locking direction that is orthogonal to the longitudinal direction of the silencer.

4. The silencer according to claim 1, wherein the attaching rail has an opening that is a thread, into which a locking means that is a worm screw or trapezoidal screw, is insertable, so that the position of the attaching rail relative to the receiving portion can be continuously adjusted.

5. The silencer according to claim 1, further comprising a guiding rail for guiding at least part of the barrel, that is arranged in the receiving portion, the guiding rail being a separate component made of a polymer material, in order to promote thermal separation between the silencer and the handgun.

6. The silencer according to claim 1, wherein the attaching rail forms, on a side facing the trigger guard, a support surface that is perpendicular and flat to the longitudinal direction of the silencer and that is configured and adapted to be in line contact with a section of the trigger guard for supporting the silencer on the trigger guard.

7. The silencer according to claim 1, wherein the attaching rail is pushed onto a link section of the receiving portion with a positive fit.

8. The silencer according to claim 1, further comprising a first engagement bolt and a second engagement bolt, that is offset from the first engagement bolt along the longitudinal direction of the silencer are arranged in the receiving portion in order to engage in a transverse slot in the mounting rail of the handgun, wherein depending on a position of the transverse slot, either the first engagement bolt or the second engagement bolt is configured and adapted to engage in the transverse slot, wherein the first engagement bolt is offset from the second engagement bolt by 12 mm.

9. The silencer according to claim 8, wherein the first engagement bolt and the second engagement bolt are pretensioned in an engagement direction that is orthogonal to the longitudinal direction, facing away from the attaching rail.

10. The silencer according to claim 1, further comprising an adapter plate that is received in the receiving portion, wherein the adapter plate has a fixing opening, that is configured and adapted to receive the barrel extension in a fixing manner.

11. The silencer according to claim 10, wherein the adapter plate is formed separately from the receiving portion and is positively received in the receiving portion, and wherein the adapter plate is made of aluminum.

12. The silencer according to claim 1, wherein the silencer has a hollow body unit with damping fins, wherein the hollow body unit forms the receiving portion, wherein the hollow body unit is formed from two aluminum shells screwed together.

13. The silencer according to claim 1, wherein the attaching rail is an injection-molded part that is a polymer injection-molded part, separate from the receiving portion.

14. A system comprising a handgun having a barrel with a barrel extension and a frame with a trigger guard, and a silencer according to claim 1, wherein the silencer has a receiving portion which receives at least a part of the barrel of the handgun, and wherein the silencer has an attaching rail which is displaceable along a longitudinal direction of the silencer to adjust the silencer to a varying distance between the barrel extension and the trigger guard so that the attaching rail is supported on the trigger guard of the handgun.

15. The system according to claim 14, further comprising a gap that is formed between the mounting rail and the attaching rail so that the attaching rail does not receive any load input directly from the mounting rail.

16. The system according to claim 14, wherein the attaching rail forms a flat support surface at right angles to the longitudinal direction of the silencer on a side facing the trigger guard, that is in line contact with a section of the trigger guard for supporting the silencer on the trigger guard.

17. The system according to claim 14, further comprising a first engagement bolt and a second engagement bolt that is offset from the first engagement bolt along the longitudinal direction of the silencer are arranged in a receiving portion of the silencer in order to engage in a transverse slot in the mounting rail of the handgun, wherein in a first setting the first engagement bolt engages in the transverse slot and the second engagement bolt does not assume an engagement function.

18. The system according to claim 14, further comprising an adapter plate that is received in the receiving portion of the silencer, and that has a fixing opening which is adapted to the handgun in terms of its size in order to receive the barrel extension in a fixing manner.

19. A method for adjusting a silencer on a handgun, comprising the steps of:

mounting the silencer on the handgun by at least a part of a barrel of the handgun being fixedly received by a receiving portion of the silencer; and moving an attaching rail of the silencer so that the attaching rail is in contact with a trigger guard of the handgun to support the silencer on the trigger guard of the handgun, wherein displacement is only possible when an attachment that is a locking pin of the silencer, is released, and moved against the attaching rail in a locking direction that is orthogonal to the longitudinal direction of the silencer, and with the aid of an external tool.

20. The method according to claim 19, wherein when the silencer is placed on the handgun, a first engagement bolt, which is offset from a second engagement bolt along the longitudinal direction of the silencer by 12 mm, engages in a transverse slot in a mounting rail of the handgun.

21. The method according to claim 19, wherein when the silencer is mounted on the handgun, an adapter plate with a fixing opening, which is positively received in the receiving portion, fixes a barrel extension of the handgun.

22. The method according to claim 19, which comprises the following steps prior to mounting:

opening two housing shells of the silencer by unscrewing;

replacing an adapter plate having a fixing opening that is configured and adapted to receive a barrel extension of the handgun in a fixing manner; and closing the two housing shells of the silencer, by screwing them shut.

* * * * *